US008138738B2

(12) United States Patent
Kunc et al.

(10) Patent No.: US 8,138,738 B2
(45) Date of Patent: Mar. 20, 2012

(54) METHOD FOR REGULATING SUPPLY VOLTAGE

(76) Inventors: Vinko Kunc, Ljubljana (SI); Maja Atanasijevic-Kunc, Ljubljana (SI); Andrej Vodopivec, Ljubljana (SI)

( * ) Notice: Subject to any disclaimer, the term of this patent is extended or adjusted under 35 U.S.C. 154(b) by 361 days.

(21) Appl. No.: 12/450,277

(22) PCT Filed: Mar. 19, 2007

(86) PCT No.: PCT/SI2007/000011

§ 371 (c)(1), (2), (4) Date: Sep. 18, 2009

(87) PCT Pub. No.: WO2008/115155

PCT Pub. Date: Sep. 25, 2008

(65) Prior Publication Data

US 2010/0090666 A1 Apr. 15, 2010

(51) Int. Cl.
*G05F 1/40* (2006.01)

(52) U.S. Cl. ..... 323/285; 323/210; 324/384

(58) Field of Classification Search ..... 323/210, 323/222, 282–290, 273, 313; 324/341, 98, 324/252, 439, 371, 425, 703; 327/262, 292, 327/158, 536, 540, 206; 365/185.18–185.28, 365/189.07, 189.09, 262

See application file for complete search history.

(56) References Cited

U.S. PATENT DOCUMENTS 4,006,403 A * 2/1977 Olsen et al. ..... 324/384
5,264,782 A * 11/1993 Newton ..... 323/288
5,612,609 A * 3/1997 Choi ..... 323/210
6,292,399 B1 * 9/2001 Le et al. ..... 365/185.21
6,294,937 B1 * 9/2001 Crafts et al. ..... 327/158
7,218,117 B2 * 5/2007 Roberts et al. ..... 324/402

* cited by examiner

*Primary Examiner* — Rajnikant Patel
(74) *Attorney, Agent, or Firm* — Jacobson Holman PLLC

(57) ABSTRACT

According to the method for regulating the supply voltage of an electronic circuit a regulating element with variable resistivity and the outer supply voltage being applied to an input terminal of said regulating element is controlled by an amplified difference between a reference voltage and a part of a regulated supply voltage whereat at first an instant, on which the regulating circuit and the electronic circuit start operating, is detected, and then such value of the reference voltage is set on said instant that the regulated supply voltage will equal a maximum allowable supply voltage of the electronic circuit and the supplied electronic circuit puts itself in a state of a maximum current consumption. Then an operating voltage drop across said regulating element is measured at regular time intervals and the reference voltage is then each time reduced by one degree until said operating voltage drop is below or equals a chosen most appropriate value of said operating voltage drop. The supplied electronic circuit puts itself in a state of a normal current consumption when said operating voltage drop has exceeded the chosen most appropriate value of said voltage drop. According to a variant embodiment the operating voltage drop is then uninterruptedly measured and, if its value decreases below a chosen minimum value of said operating voltage drop due to a disturbance in the outer supply voltage, a flag is set in a memory in the case of a disturbance potentially dangerous to the electronic circuit.

14 Claims, 2 Drawing Sheets

METHOD FOR REGULATING SUPPLY VOLTAGE

This is a national stage of PCT/SI07/000011 filed Mar. 19, 2007 and published in English, hereby incorporated by reference.

The present invention relates to a method for regulating the supply voltage of an electronic circuit, according to which method a regulating element with variable resistivity that conducts a supply current for the electronic circuit in a regulating circuit and to an input terminal of which an outer supply voltage is applied, is controlled by an amplified difference between a reference voltage and a part of regulated supply voltage, whereat the method of the invention is suitable to supply data processing devices with electric current.

One of basic requirements at laying out electronic circuits is to guarantee their stability when the supply voltage changes or there are disturbances in the supply voltage.

By regulating the supply voltage of an electronic circuit it is desired to attain the voltage suitable for the electronic circuit by means of the lowest available voltage on the one hand and it is desired to reduce the level of disturbances in said available voltage as far as possible on the other hand. Both desires are contrary to each other since the level of the disturbances in the available voltage is reduced the more successfully the higher difference between the available voltage and the voltage supplying the electronic circuit. Hence, a higher voltage drop across a regulating circuit secures a better resistance to disturbances present in the available voltage. On the contrary, however, the requirement of the highest possible regulated voltage at the given available voltage means a lower voltage drop across the regulating circuit.

When disturbances present in the supply voltage are high or the supplied electronic circuit has low resistance to the disturbances, the quality of the supply voltage with regard to stability and the level of the disturbances must be improved by regulating the supply voltage.

Figure 1:
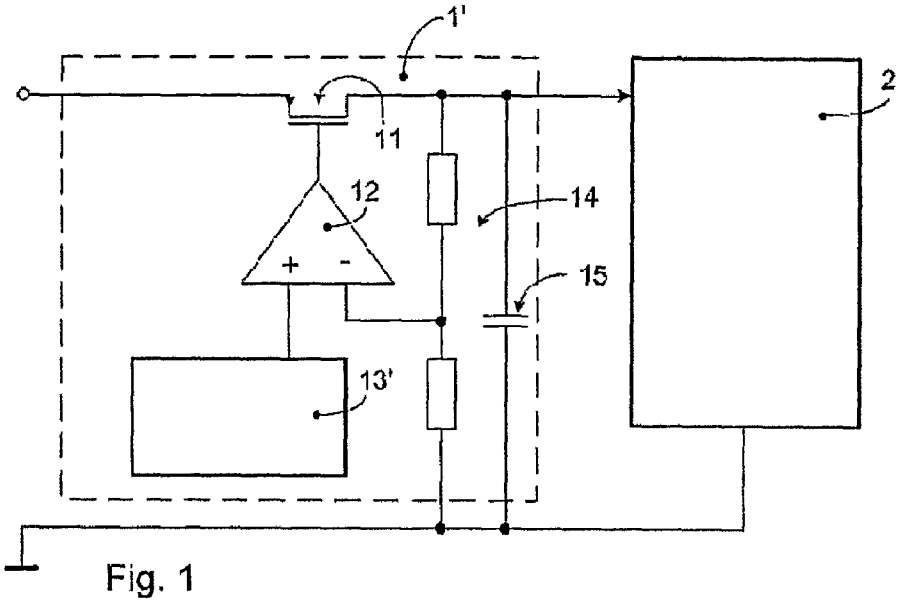

A known regulating circuit 1' is used (e.g. US 20030111987A1 and US 20050248325A1), for instance, whose regulated output voltage supplies an electronic circuit 2 (FIG. 1). The outer supply voltage at an input of the regulating circuit 1' must exceed the regulated supply voltage and is not allowed to vary to a larger extent. A regulating transistor that conducts the supply current for the electronic circuit 2 and to whose input terminal the outer supply voltage is applied, is used as a regulating element 11 having a variable resistance. Its conductivity is controlled by the output voltage of an amplifier 12, which amplifies difference between a constant reference voltage from a generator 13' and a part of the regulated supply voltage as determined by a voltage divider 14—it is blocked by a blocking capacitor 15.

Moreover, a circuit for regulating the supply voltage is known (US 2003/0111987), by which, in spite of a low voltage drop across this circuit, the resistance to disturbances in the outer supply voltage is improved by controlling a variable resistance regulating element with an output voltage of a subtractor subtracting the output voltage of an error amplifier from the outer supply voltage, which amplifier amplifies the difference between a constant reference voltage and a part of the regulated supply voltage as determined by a voltage divider. The response to disturbances present in the supply voltage is faster since at least a part of the control voltage is obtained irrespective of a feedback circuit having a limited speed of response because of a necessary stability.

But already at the outer supply voltage being higher than the provided one no, reasonable compromise between the voltage drop across the regulating circuit and its resistance to disturbances is attainable. Therefore the described regulating circuit does not function very well when the outer supply voltage may change during the operation or when the same regulating circuit should operate in a broader range of the outer supply voltage.

When it is necessary to supply an electronic circuit operating in a broad range of the supply voltage and needing the highest possible regulated supply voltage at a given outer supply voltage in order to attain the highest possible output power, the regulated supply voltage must be specially set at each larger variation of the outer supply voltage in order to achieve optimal operation. The optimal operation is achieved when the regulated voltage is the highest possible and at the same time the regulating circuit functions in a satisfactory manner.

The invention solves the technical problem how to perform a method for regulating the supply voltage so that at each available outer supply voltage a high-quality regulated supply voltage will be the highest possible with regard to expected disturbances in the outer supply voltage.

Said technical problem is solved by the proposed method for regulating supply voltage as characterized by the features of the characterizing portion of the first claim, and the variants of the embodiment are characterized by dependent claims.

The method of the invention for regulating supply voltage makes possible an automatic setting of the supply voltage to the highest possible value, whereat, however, its quality with respect to lowering the level of disturbaces is guaranteed.

The invention will now be explained in more detail by way of the description of an embodiment and its variants with reference to the accompanying drawing representing in FIG. 1 a known regulating circuit, FIG. 2 a regulating circuit, by which the method of the invention for regulating the supply voltage is carried out, and FIG. 3 a graph representing the time dependence of the following quantities after the operating start of the regulating circuit and of a supplied electronic circuit from FIG. 2, namely

- of the outer supply voltage and the regulated supply voltage (1st window), of the voltage drop across the regulating circuit (2nd window) carrying out the method of the invention, and
- of a current at the output of the regulating circuit (3rd window) supplying the electronic circuit.

Figure 2:
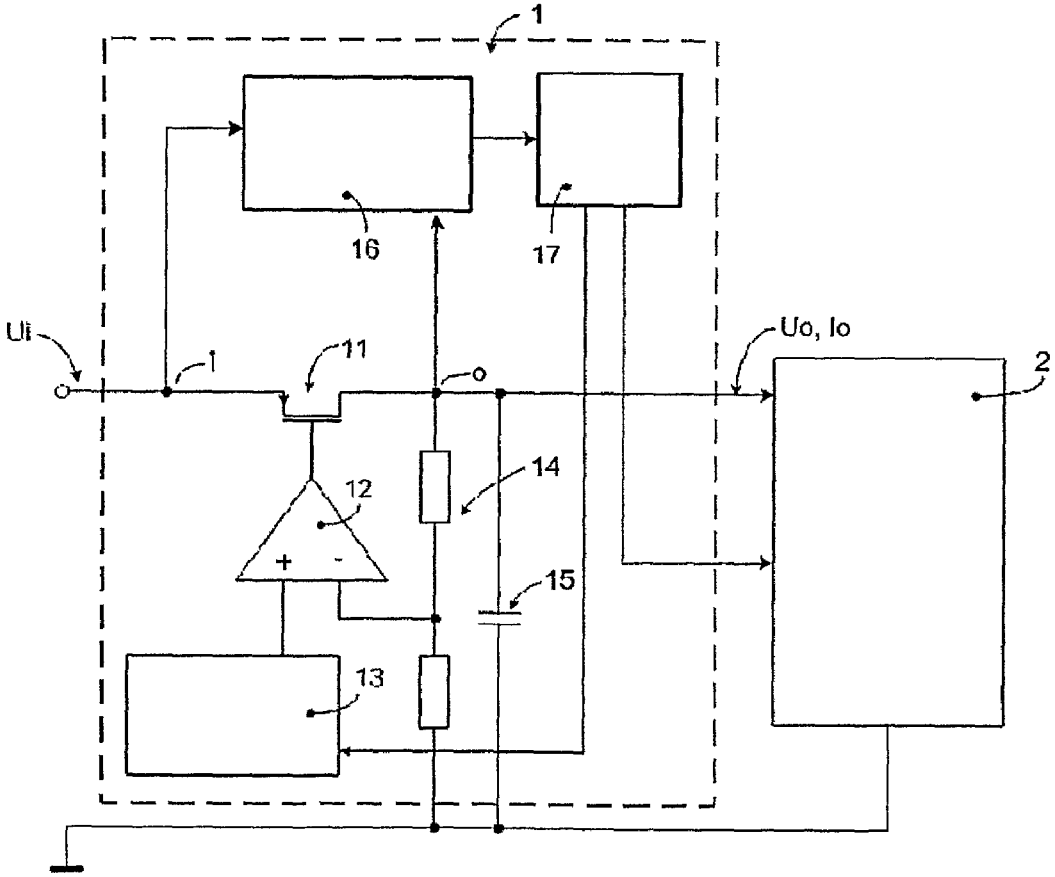

The method of the invention for regulating the supply voltage Uo may be carried out with a regulating circuit 1, whose output regulated voltage Uo at its output terminal o supplies an electronic circuit 2 with an electric current Io (FIG. 2). A regulating element 11, at whose input terminal i there is an outer supply voltage Ui, is controlled by an output voltage of an amplifier 12, which amplifies the difference between a reference voltage output from a controlled generator 13 of the varying reference voltage and a part of the regulated supply voltage Uo as set by means of a voltage divider 14, which is shunted by a blocking capacitor 15. A voltage drop across the regulating element 11 as measured by a measuring instrument 16 is applied to a control circuit 17, which according to the method of the invention for regulating the supply voltage Uo sets a value of the reference voltage at the output of the generator 13 on the one hand and puts the electronic circuit 2 in a state of a maximum current consumption on the other hand.

Figure 3:
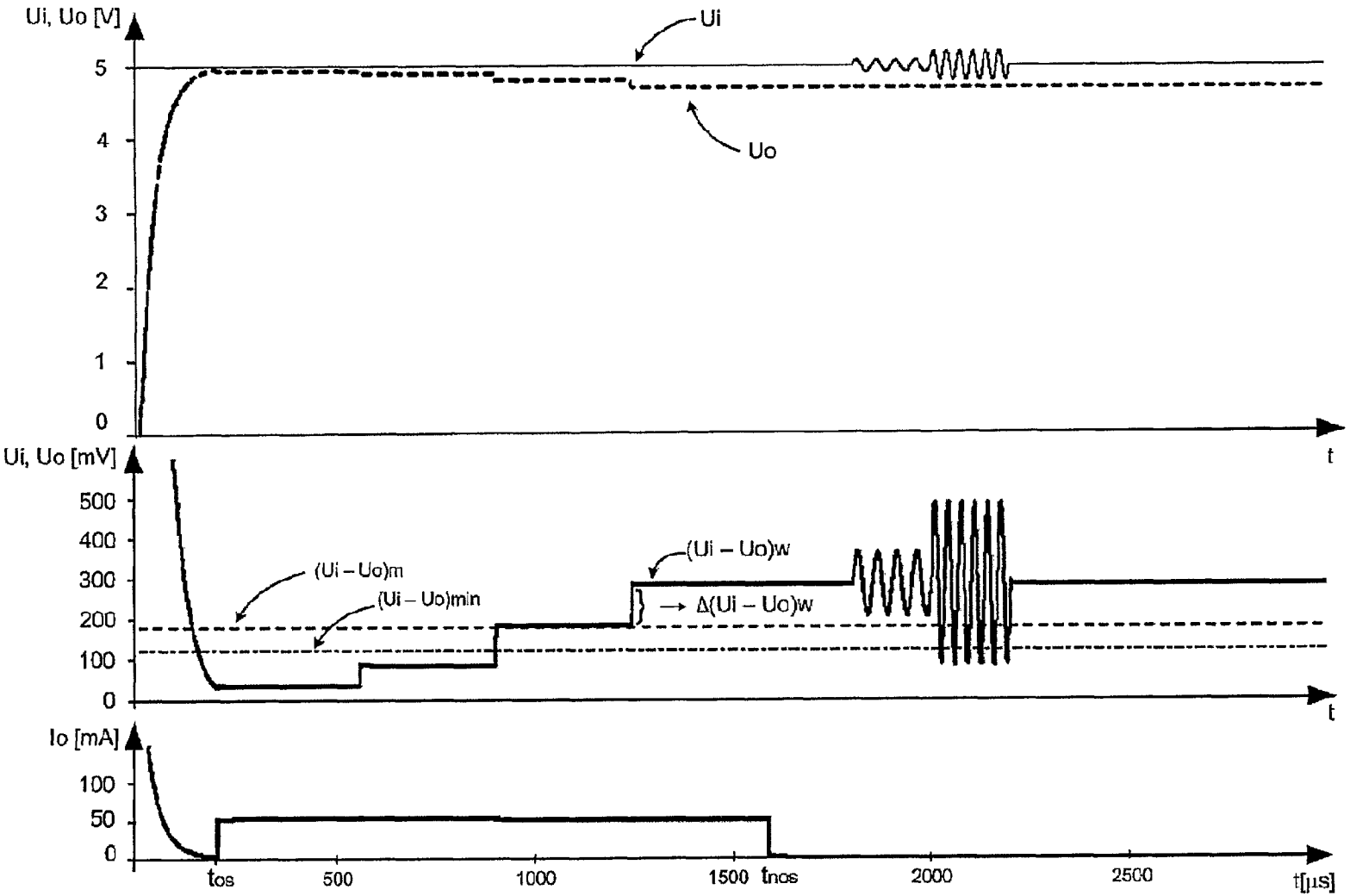

According to the proposed method in a first step an instant tos is detected, on which the regulating circuit 1 and the electronic circuit 2 start operating (1st window in FIG. 3). The instant tos, on which the regulating circuit and the electronic circuit start operating, is that instant, on which two differences, namely of the outer supply voltage Ui and of the regulated supply voltage Uo as obtained in two measurements one after another, decrease below a chosen value, e.g. ranged in an interval from 10 mV to 100 mV. However, the instant tos of the operating start may be also determined by a signal provided to set up an operation state in the supplied electronic circuit 2.

In the second step of the proposed method such value of the reference voltage is set on said instant tos of the operation start that the regulated supply voltage Uo will equal a maximum allowable supply voltage of the electronic circuit 2 (2nd window in FIG. 3). At the same time the supplied electronic circuit 2 puts itself in the state of the maximum current consumption (3rd window in FIG. 3). The regulating circuit 1 is then fully loaded. Hence the setting is carried out under most demanding operation conditions.

In several following steps, the operating voltage drop (Ui-Uo)w across said regulating element 11 is measured at regular time intervals of a few milliseconds and the reference voltage is then each time reduced by one degree. It means that the operating voltage drop (Ui-Uo)w increases in regular time intervals of 0.1 millisecond to several milliseconds in degrees of ΔUow, whose values range in an interval from 20 mV to 300 mV (2nd window in FIG. 3). Such steps are carried out until said operating voltage drop (Ui-Uo)w is below or equals a chosen most appropriate value (Ui-Uo)optim of said operating voltage drop to be defined below.

After said operating voltage drop (Ui-Uo)w has exceeded the chosen most appropriate value (Ui-Uo)optim of said operating voltage drop, a following step of the proposed method is carried out on the instant tnos, in which step the supplied electronic circuit 2 puts itself in a state of a normal current consumption. The carried out setting of the regulating circuit 1 is stored in a memory.

The regulated supply voltage Uo is now set according to the embodiment of the method of the invention.

According to a variant of the embodiment, however, said operating voltage drop (Ui-Uo)w is nevertheless measured uninterruptedly from then on. If its value decreases below the chosen minimum value (Ui-Uo)min of said operating voltage drop due to disturbances in the outer supply voltage Ui, as a next step of the proposed method a flag is set in the memory in the case of a disturbance potentially dangerous to the electronic circuit 2—to be defined below. The flag alerts that after a first operating start of the regulating circuit 1 and the electronic circuit 2 following the flag setting in the memory, a following step according to the proposed method should be carried out: the electronic circuit 2 should be supplied at said operating voltage drop (Ui-Uo)w increased for one degree ΔUow.

According to the proposed method the regulating circuit 1 and the electronic circuit 2 can start operating after the setting of the flag in the memory at the operating voltage drop (Ui-Uo)w increased for one degree ΔUow already when the electronic circuit 2 for the first time changes over into a quiescent or stand-by state, for instance, when the proposed method is used to supply a computer.

Here the minimum value of said operating voltage drop (Ui-Uo)w that still enables the regulating circuit 1 to operate normally is chosen as said minimum value (Ui-Uo)min of said operating voltage drop (2nd window in FIG. 3). The desired level of reducing disturbances present in the outer supply voltage Ui is defined by means of said necessary minimal voltage drop across the regulating circuit 1. Accordingly, the method of the invention allows that the outer supply voltage Ui varies and also that the same regulating circuit 1 is used for various outer supply voltages Ui. The regulated supply voltage Uo is adjusted to the outer supply voltage Ui in a way that a compromise between two opposite requirements is attained, namely for the highest possible regulated supply voltage Uo and for the desired level of reducing disturbances present in the outer supply voltage Ui. The minimum value (Ui-Uo)min of the operating voltage drop across the regulating circuit 1 is chosen to be in an interval ranging from 100 mV to 500 mV and it equals 120 mV in the embodiment according to FIG. 3. It is set in a configuration register of the control circuit 17. But the user can set a higher value, if it appears to him to be appropriate with regard to his knowledge of the nature of the disturbances present in the outer supply voltage Ui.

Said minimum value (Ui-Uo)min of said operating voltage drop increased by an expected level of the disturbances in the outer supply voltage Ui is chosen as said most appropriate value (Ui-Uo)optim of said operating voltage drop.

A disturbance with one of the two following features, which is present in the outer supply voltage Ui, is recognized as a disturbance potentially dangerous to the electronic circuit 2:

- under its influence the operating voltage drop (Ui-Uo)w decreases below the chosen minimum value (Ui-Uo)min for the duration of the halfperiod of a signal with the highest frequency entering the electronic circuit 2 or of the halfperiod of internal signals with the highest frequency of the electronic circuit 2;
- short-time disturbances occur with a frequency below the highest frequency of the signal entering the electronic circuit 2 or of the internal signals of the electronic circuit 2.

According to the method of the invention, the regulating circuit 1 and the electronic circuit 2 start operating again at the operating voltage drop (Ui-Uo)w increased for one degree ΔUow also after the first operating start of the regulating circuit 1 and of the electronic circuit 2, after said operating voltage drop has before been increased for ΔUow due to the disturbances being potentially dangerous, only if in the previous operation even at said increased operating voltage drop the value of the operating voltage drop at any time repeatedly decreased below the chosen maintaining value (Ui-Uo)m of said operating voltage drop due to the disturbances in the outer supply voltage Ui.

Here the minimum value (Ui-Uo)min of said operating voltage drop increased by one degree ΔUow of increasing said operating voltage drop is chosen as said maintaining value (Ui-Uo)m of said operating voltage drop (2nd window in FIG. 3). The maintaining value (Ui-Uo)m of said operating voltage drop is approximately 1.5 times the minimum value (Ui-Uo)min of said operating voltage drop. It is chosen in an interval ranging from 120 mV to 700 mV.

The invention claimed is:

1. Method for regulating the supply voltage Uo of an electronic circuit, according to which method a regulating element with variable resistivity that conducts a supply current for the electronic circuit in a regulating circuit and to an input terminal of which an outer supply voltage Ui is applied, is controlled by an amplified difference between a reference voltage and a part of a regulated supply voltage Uo, characterized in that an instant, on which the regulating circuit and the electronic circuit start operating, is detected, that such value of the reference voltage is set on said instant of the operation start that the regulated supply voltage Uo will equal a maximum allowable supply voltage of the electronic circuit and the supplied electronic circuit puts itself in a state of a maximum current consumption, that an operating voltage drop (Ui-Uo)w across said regulating element is measured at regular time intervals and the reference voltage is then each time reduced by one degree until said operating voltage drop (Ui-Uo)w is below or equals a chosen most appropriate value (Ui-Uo)optim of said operating voltage drop, and that the supplied electronic circuit puts itself in a state of a normal current consumption, when said operating voltage drop (Ui-Uo)w has exceeded the chosen most appropriate value (Ui-Uo)optim of said voltage drop.

2. Method as recited in claim 1, characterized in that said operating voltage drop (Ui-Uo)w is uninterruptedly measured from putting into normal current conditions on and, if its value decreases below a chosen minimum value (Ui-Uo)min of said operating voltage drop due to a disturbance in the outer supply voltage Ui, a flag is set in a memory in the case of a disturbance potentially dangerous to the electronic circuit, which flag indicates that the electronic circuit should be supplied at said operating voltage drop (Ui-Uo)w increased for one degree ΔUow after a first operating start of the regulating circuit and the electronic circuit following the flag setting in the memory.

3. Method as recited in claim 2, characterized in that the decrease of said operating voltage drop (Ui-Uo)w below chosen minimum value (Ui-Uo)min of said operating voltage drop at least in a duration of a halfperiod of a signal with highest frequency entering the electronic circuit or of a halfperiod of a internal signals with highest frequency in the electronic circuit is recognized to be a disturbance potentially dangerous to the electronic circuit.

4. Method as recited in claim 2, characterized in that short-time disturbances occurring with a frequency below the highest frequency of the signal entering the electronic circuit or of the internal signals of the electronic circuit are recognized to be disturbances potentially dangerous to the electronic circuit.

5. Method as recited in claim 3, characterized in that after the flag has been set in the memory, the regulating circuit and the electronic circuit start operating at the operating voltage drop (Ui-Uo)w increased for one degree ΔUow, when the electronic circuit for the first time changes over into a quiescent state or a stand-by state.

6. Method as recited in claim 3, characterized in that also after the first operating start of the regulating circuit and the electronic circuit, after said operating voltage drop (Ui-Uo)w has before been increased for one degree ΔUow due to the potentially dangerous disturbances, the regulating circuit and the electronic circuit restart operating at the operating voltage drop increased for one degree ΔUow only if, in the previous operation also at said increased operating voltage drop, the value of the operating voltage drop has ever repeatedly decreased below a chosen maintaining value (Ui-Uo)m of said operating voltage drop due to the disturbances in the outer supply voltage Ui.

7. Method as recited in claim 1, characterized in that the instant, on which the regulating circuit and the electronic circuit start operating, is the instant, on which two differences of two values, namely of the outer supply voltage Ui and the regulated supply voltage Uo, measured one after another, decrease below a chosen value ranged in an interval from 10 mV to 100 mV.

8. Method as recited in claim 7, characterized in that said operating voltage drop (Ui-Uo)w in the state of maximum current consumption is increased in regular time intervals of 0.1 millisecond to several milliseconds in the degrees ΔUow, whose values range in an interval from 100 mV to 300 mV.

9. Method as recited in claim 8, characterized in that a minimum value of said operating voltage drop (Ui-Uo)w, which still enables the regulating circuit to operate normally, is chosen as said minimum value (Ui-Uo)min of said operating voltage drop.

10. Method as recited in claim 9, characterized in that the minimum value (Ui-Uo)min of said operating voltage drop is chosen in an interval ranging from 100 mV to 500 mV.

11. Method as recited in claim 9, characterized in that said most appropriate value (Ui-Uo)optim of said operating voltage drop, increased by a provided level of the disturbances in the outer supply voltage (Ui), is chosen as said most appropriate value (Ui-Uo)min of said operating voltage drop.

12. Method as recited in claim 11, characterized in that said minimum value (Ui-Uo)min of said operating voltage drop, increased by one degree ΔUow at increasing said operating voltage drop, is chosen as said maintaining value (Ui-Uo)m of said operating voltage drop.

13. Method as recited in claim 12, characterized in that the maintaining value (Ui-Uo)m of said operating voltage drop is approximately 1.5 times the minimum value (Ui-Uo)min of said operating voltage drop.

14. Method as recited in claim 12, characterized in that the maintaining value (Ui-Uo)m of said operating voltage drop is chosen in an interval ranging from 120 mV to 700 mV.

* * * * *